US006159107A

United States Patent [19]

Walton

[11] Patent Number: 6,159,107

[45] Date of Patent: Dec. 12, 2000

[54] METHOD AND APPARATUS FOR GOLF CLUB SHAFT SUPPORT

[75] Inventor: Billy Dan Walton, Ranger, Tex.

[73] Assignee: Billy D. Walton, Ranger, Tex.

[21] Appl. No.: 09/231,505

[22] Filed: Jan. 14, 1999

Related U.S. Application Data

[60] Provisional application No. 60/072,711, Jan. 27, 1998.

[51] Int. Cl.[7] ..... A63B 55/10

[52] U.S. Cl. ..... 473/282; 248/520

[58] Field of Search ..... 473/282, 286; 248/156, 530, 511, 520

[56] References Cited

U.S. PATENT DOCUMENTS 4,805,911 2/1989 Ferlazzo ..... 473/282
4,822,052 4/1989 Dimmick ..... 473/282

*Primary Examiner*—Jeanette Chapman
*Assistant Examiner*—Stephen L. Blau

[57] ABSTRACT

The invention consists of a combination of a golf club and a telescoping support assembly. The support assembly has an inner tube connected to a support section which is designed to be inserted into an outer tube that is inserted into the hollow handle end of a golf club at the vent hole of a grip. The purpose of the support assembly is to hold the grip of the club above the ground at a height sufficient to keep the grip from becoming wet. The outer tube is retained inside the handle end of the golf club by a barbed shoulder integral to the outer tube which engages with the vent hole of the grip. This prevents the outer tube from being inadvertently pulled out of the grip. The outer tube is of sufficient length to prevent the hinge between the inner tube and support section when stowed inside the outer tube from excessive movement inside the club grip and shaft. The outer tube is designed with a 45 degree angle on the first end of the tube that matches a 45 degree angle on the first end of the inner tube to act as a stop and locking mechanism when the inner tube and support section is extended and hinged at a 90 degree angle.

2 Claims, 6 Drawing Sheets method and apparatus for golf club shaft support method and apparatus for golf club shaft support # method and apparatus for golf club shaft support

OUTER TUBE

SCALE: 1 mm = 1 mm

METHOD AND APPARATUS FOR GOLF CLUB SHAFT SUPPORT

CROSS REFERENCE

Continuation of Provisional Patent Application No. 60/072,711 dated Jan. 27, 1998.

BACKGROUND OF THE INVENTION

1. Field of the Invention

This invention relates generally to the game of golf, and more specifically to golf clubs and a method and apparatus used for holding a golf club handle or shaft sufficiently far above the ground so that it does not get wet or dirty when the club is set down upon the ground.

2. Description of the Prior Art

In the past, inventors have directed their efforts towards golf clubs with improved grips having a golf tool externally mounted to hold the golf club handle above the ground. U.S. Pat. No. 4,545,579 discloses such a golf club and a golf club support. A stationary section having a semicylindrical sleeve clips to the outside of the club shaft below the handle. A support section is pivotally attached to the stationary section and supports the club grip above the playing surface when the support is extended and the club placed on the ground.

U.S. Pat. No. 4,063,731 teaches a multi-purpose golfer's tool which has a grip groove to support a club shaft above the playing surface. The tool is set on the ground and does not pivotally attach to the club shaft.

U.S. Pat. No. 4,210,334 discloses a pivotal support spike attached to the shaft of a golf club which provides a standoff for lifting the club handle off the ground when the club is laid down. The pivotal support is attached to the outside of the club shaft.

The present invention is essentially an integral part of the club once installed. The telescoping feature of the present invention allows the support to be totally stowed inside the grip during play. As a result, the golfer is not distracted by an external prop attached to the club shaft. Because the present invention lies along the longitudinal axis of the hollow club shaft, there is no imbalance created in the handle which may effect the club stroke.

SUMMARY OF THE INVENTION

The present invention consists of a combination golf club and a telescoping golf club support which is designed to be inserted into the club grip vent hole and a method for retrofitting a golf club. The purpose of the support is to hold the grip of the golf club far enough above the ground to keep it dry and clean when the golf club is laid down on the ground. The support assembly is retained inside the hollow grip by a barbed shoulder ring integral to the support outer tube. The grip end cap retains the outer tube inside the grip with the barb shoulder ring urging against the inside of the end cap thereby preventing the support outer tube from being inadvertently pulled out. The support section and inner tube are hinged together and are part of a telescoping assembly which when stowed does not affect the aerodynamics of the golf club or interfere with the golfers vision of the ball. When extended, the support section may be rotated 90 degrees to the grip and club head to space the grip above the ground and keep the grip from becoming wet or dirty.

BRIEF DESCRIPTION OF DRAWINGS

The invention will be better understood and objects other than those set forth above will become apparent when consideration is given to the following detailed description of the preferred embodiments. Such description makes reference to the annexed drawings wherein.

DESCRIPTION OF THE PREFERRED EMBODIMENT

Figure 1:
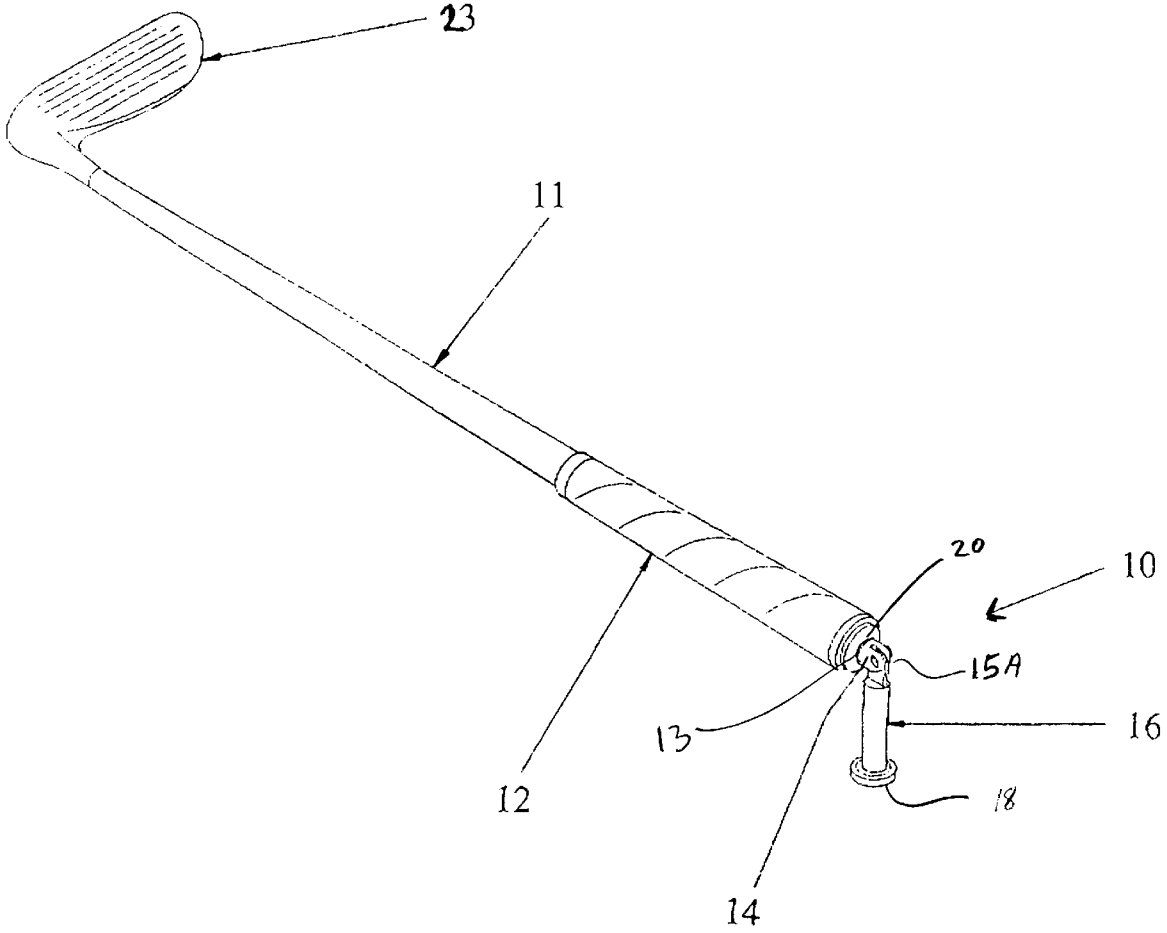
FIG. 1 is a perspective view showing the golf club support assembly in a supporting position as installed in the club grip vent hole.

FIG. 1 shows the golf club support assembly 10 installed within the vent hole 13 and supporting the golf club handle 11 thereby keeping the grip 12 of the club above the ground clean and dry. The support assembly 10 may be made of any rigid material construction. The inner tube 14 and hinge 15A of the support assembly 10 extend outwardly from the expandable, grip vent hole 13. The hinged support section 16 is extended and rotated 90 degrees downward. It is also rotated axially to be oriented at right angles to the club head 23 when supporting the golf club. This is required for balancing the golf club handle 11 on the support section 16. Support flange 18 rests against the playing surface or ground.

Figure 2:
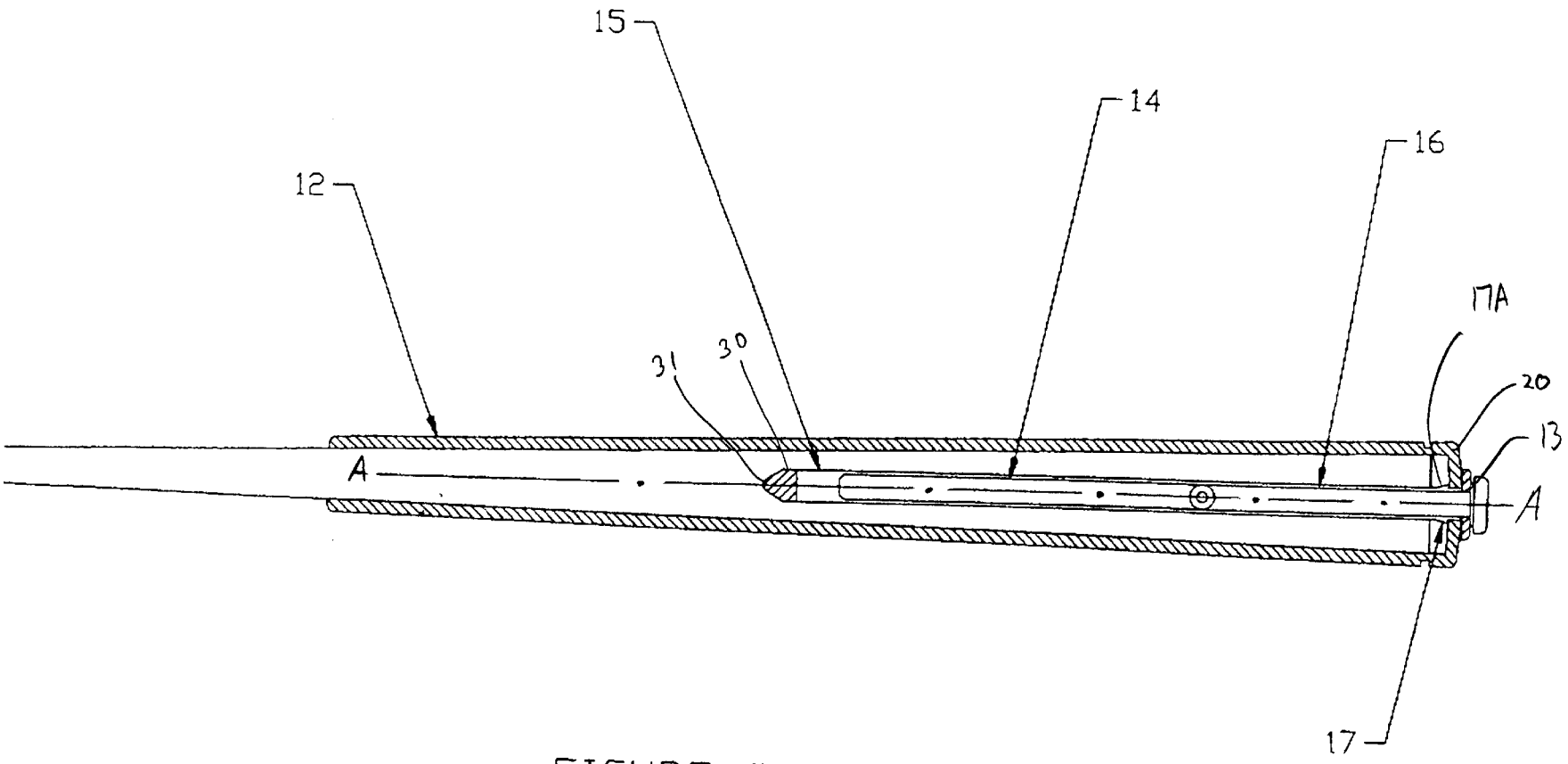
FIG. 2 is a sectional side view of the present invention installed in the club grip with the inner tube and hinged support section telescoped inside the outer tube. This stowed position represents the configuration of the club and support when used for play.

FIG. 2 illustrates the outer tube 15 having a longitudinal axis A aligned with the longitudinal asis of the handle and secured within the club grip 12. The longitudinal axis of the inner tube 14, the hinge 15, and the support section 16 also align with axis A. Inner tube 14, hinge 15, and support section 16 all telescope inside the outer tube 15 for storage inside the grip 12. The tubes may be nickel-plated, thin-wall, brass or any suitable compositions which are designed to have sliding friction sufficient to maintain either stowed or extended position. Positional friction is required to prevent undesired extension of the support assembly 10 when the golf club is placed grip-first into a golf bag. The outer tube retention barb 17 urges against the grip end cap 20 with sufficient compression force so that unintentional removal of the assembly 10 and outer tube 15 is practically impossible.

The method of installing the assembly 10 to retrofit an existing club with a rubber or comparable composition end cap 20 having a vent hole 13 expandable from a first relaxed position to a second expanded position begins by inserting the first end 30 of the outer tube 15 into the vent hole 13. The outside diameter of the outer tube 15 is slightly larger than the diameter of the expandable vent hole when the vent hole is in the first relaxed position. The tapered first end 30 having a narrow lip 31 which has a smaller diameter than the relaxed vent hole diameter enables the outer tube to begin to enter the hole 13. An appropriate lubricant may be applied to the outer tube prior to insertion. The vent hole 13 must stretch a little to accept the outer tube as it is urged into the hole 13. The outer tube is pushed into the expanding vent hole and through the hollow handle until the tapering retention barb 17 reaches the hole opening. The barb 17 has a tapering shoulder ring 17A which is forcably driven into the expanded hole. The tapering ring has a flat shoulder portion (the barb) which will not pull out once it passes through the hole 13, which has been stretched to the maximum and then contracts to the second expanded position. This type of taper lock is well known in the art.

Figure 3:
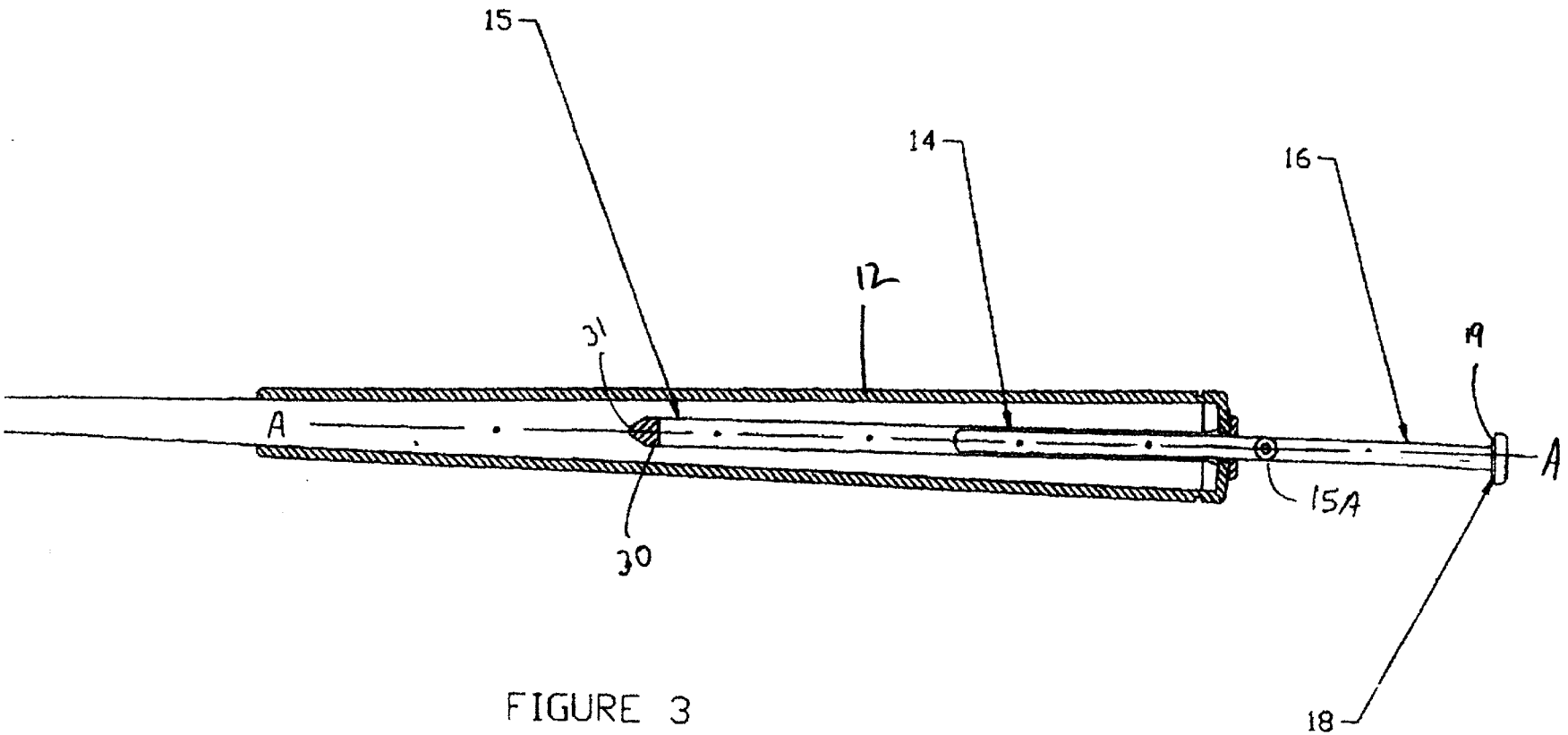
FIG. 3 is a sectional side view of the present invention with the outer tube retained within the grip but the inner tube and hinged support section extended as pulled out by the golfer.

FIG. 3 shows the support section 16 extended from within the grip 12. A step 19 at the support flange 18 allows a finger-nail grip necessary to extend the support section 16. An interference fit exists between the inner tube 14 and outer tube 15 to prevent separation and provide axial resistuice necessary to maintain stability of the support section 16 when fully extended.

Figure 4:
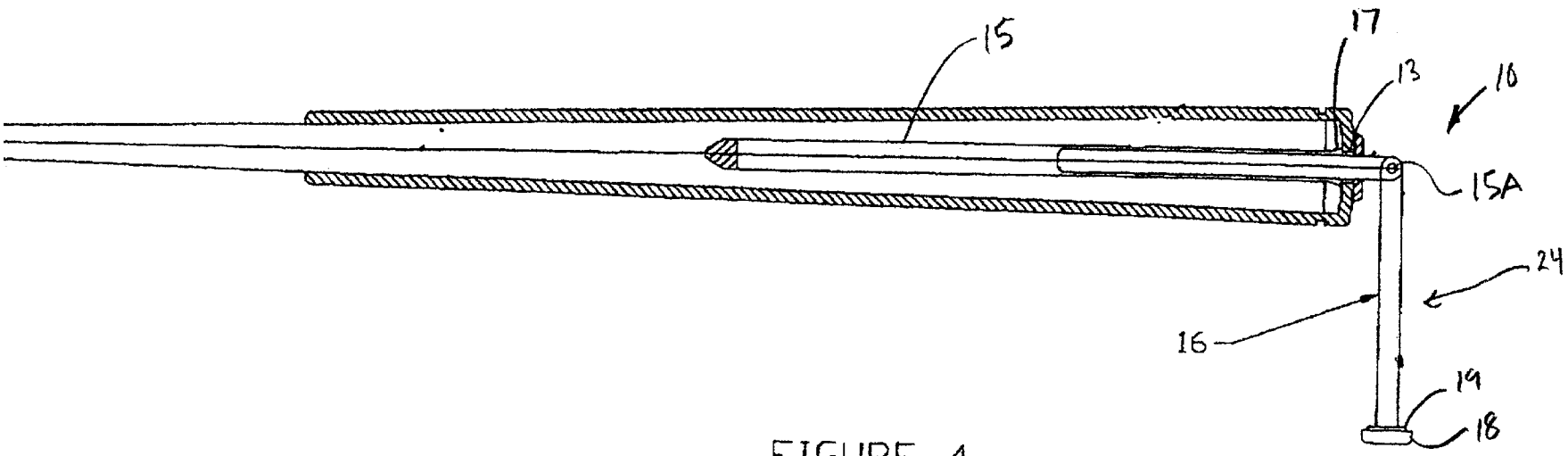
FIG. 4 is a sectional side view with the support section rotated 90 degrees downward which would be in preparation of the club being laid on the ground.

FIG. 4 shows the support section 16 extended and pivoted 90 degrees to form the prop leg 24 of the club and support assembly 10. In addition to axial friction between the inner and outer tubes, sufficient frictional resistance to rotation at the hinge is incorporated to maintain the 90 degree position of the support section 16.

Figures 5, 6:
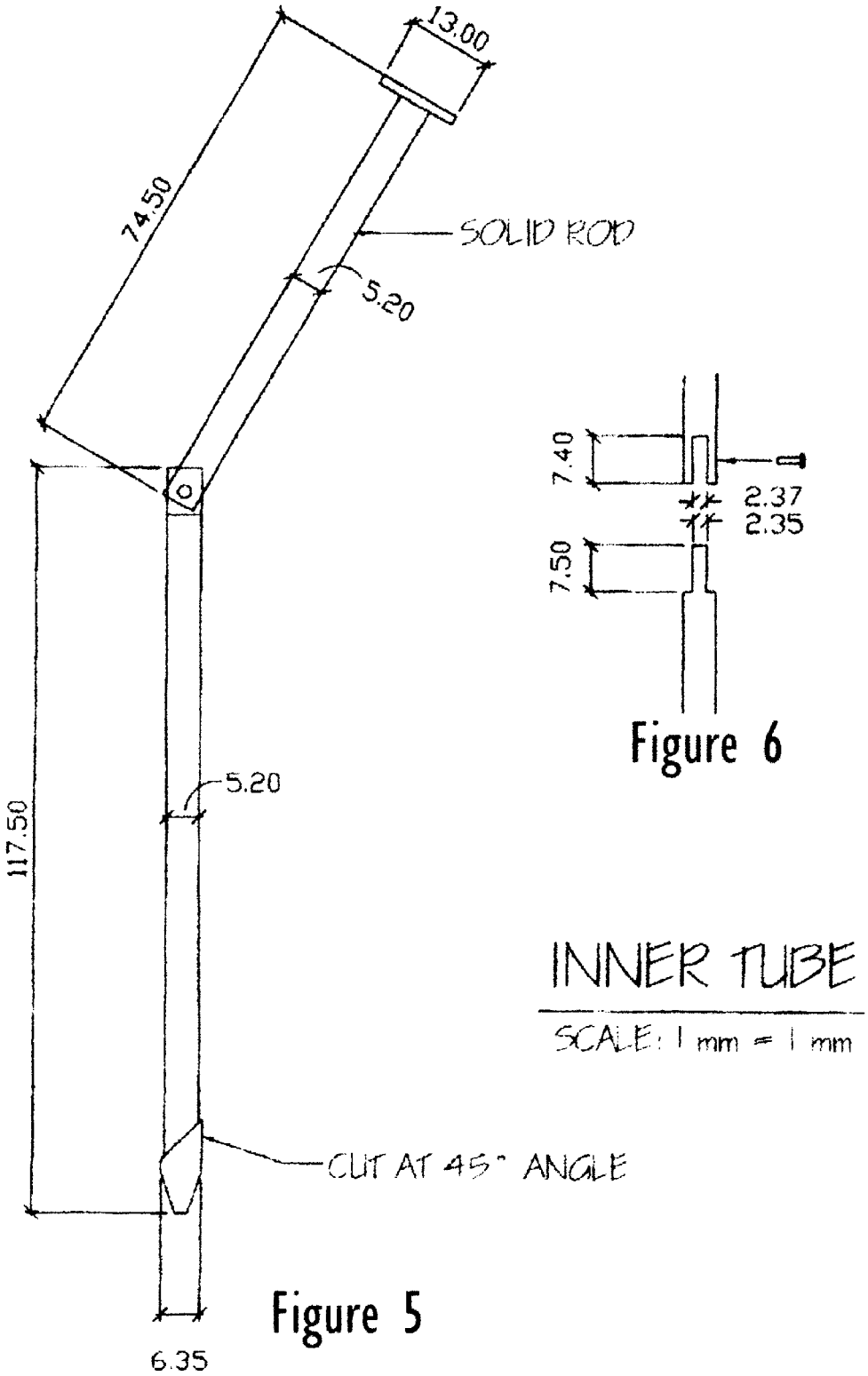
FIG. 5 is another embodiment of which shows an inner tube having a stop mechanism.
FIG. 6 is a side view of the hinge.
Figure 7:
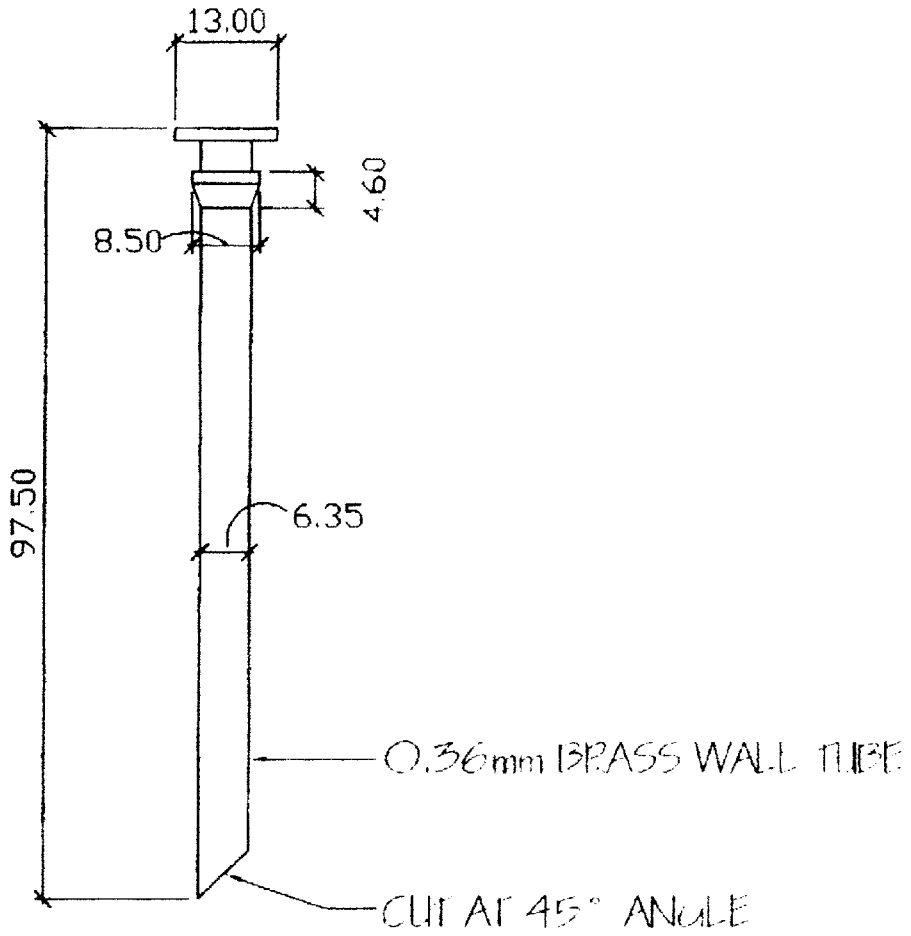
FIG. 7 is another embodiment which shows an outer tube having a stop mechanism.

FIG. 5 shows an inner tube having a first end with a stop mechanism having a 45 degree angle to match the 45 degree angle of the first end of the outer tube shown in FIG. 7. This is to stop the support section and inner tube from being withdrawn any further from the outer tube and to lock the inner tube rotationally in the outer tube when the inner tube and support section are extended from the outer tube. FIG. 6 shows how to assemble the hinge.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. A golf club in combination with a support assembly comprising:

A golf club having a generally hollow handle with a longitudinal axis and a grip with a vent hole expandable from a first relaxed position to a second expanded position;

A support assembly having a generally hollow outer tube having a longitudinal axis with a first end and a second end, said longitudinal axis of the outer tube being aligned with said longitudinal axis of said handle, said second end of the outer tube having a tapering barb shoulder, the outer tube having a diameter larger than a diameter of said vent hole of the grip when said vent hole is in said first relaxed position, and said first end of the outer tube having a 45-degree angle;

A support assembly having an inner tube with a first end and a second end with said first end of the inner tube being pointed and having a stop mechanism with a 45-degree angle to match the first end of the outer tube; and A support assembly having a support section having a first end and a second end, said first end of the support section being pivotally attached to said second end of the inner tube, and said support section having a flange attached to said second end of said support section wherein said inner tube and support section telescopingly slide within said outer tube along said longitudinal axis of said outer tube.

2. A method for retrofitting a golf club handle having a longitudinal axis and a grip having a vent hole expandable from a first relaxed position to a second expanded position to provide a support to maintain said handle above the ground surface when said club is placed on the ground comprising steps of:

Inserting within said vent hole a first end of a support assembly having an outer tube with a first end and a second end, said first end of said outer tube being pointed with a 45 degree angle, said outer tube being generally hollow and having a longitudinal axis, said longitudinal axis of said outer tube being aligned with said longitudinal axis of said handle, said outer tube having a diameter larger than a diameter of said vent hole when the vent hole is in said first relaxed position, said support assembly having an inner tube having a first end and a second end, a stop mechanism being attached to said first end of said inner tube with a 45-degree angle to match said first end of said outer tube, said support assembly having a support section with a first end and second end, said first end of said support section being pivotally attached to said second end of said inner tube, and said support section having a flange attached to said second end of said support section, and wherein said inner tube and support section telescopingly slide within said outer tube along said longitudinal axis of said outer tube;

Urging said outer tube into said expandable vent hole until a tapering barb shoulder on said second end of said outer tube contacts the outer sides of said hole, said barb having a diameter slightly larger than said outer tube; and Driving said barb into and through said expandable vent hole to retain said outer tube inside said vent hole when said vent hole is in said second expanded position.

* * * * *